United States Patent [19]

Norris

[11] Patent Number: 4,537,173

[45] Date of Patent: Aug. 27, 1985

[54] FREE-RUNNING ROTARY INDUCTION SYSTEM

[76] Inventor: Claude R. Norris, 9030 Normandy La., Dayton, Ohio 45459

[21] Appl. No.: 655,188

[22] Filed: Sep. 26, 1984

[51] Int. Cl.[3] ..... F02M 29/02

[52] U.S. Cl. ..... 123/592; 48/189; 261/79 R

[58] Field of Search ..... 123/592; 48/189.4, 189.5; 261/79 R

[56] References Cited

U.S. PATENT DOCUMENTS

| | | | |
|---|---|---|---|
| 787,254 | 4/1905 | Young | 123/592 |
| 942,503 | 12/1909 | Jacobs | 123/592 |
| 1,386,297 | 8/1921 | Wilsey | 123/592 |
| 2,027,480 | 1/1936 | Higley | 123/592 |
| 2,746,851 | 5/1956 | Holzhausen | 48/189.5 |
| 2,784,069 | 5/1957 | Falzone | 48/189.5 |
| 2,969,782 | 1/1961 | Falzone | 123/592 |
| 3,952,716 | 4/1976 | McCauley | 123/592 |
| 4,059,082 | 11/1977 | McCauley | 123/592 |
| 4,399,800 | 8/1983 | Weindelmayer | 123/592 |
| 4,422,432 | 12/1983 | Knox, Sr. | 123/592 |

*Primary Examiner*—E. Rollins Cross

*Attorney, Agent, or Firm*—Biebel, French & Nauman

[57] ABSTRACT

A fuel distribution system for a multi-cylinder internal combustion engine includes an intake manifold having a tubular inlet stack with an inlet including a mounting for a carburetor on the top thereof and a plurality of runner passages extending generally transverse to the bottom of the stack and to intake ports at each cylinder. The manifold includes a housing downstream of the stack providing a freely rotatable mounting for a shaft having a plurality of axial flow turbine blades thereon and a radial flow impeller is also mounted on the shaft, spaced from the turbine blades. The stack has a cylindrical interior wall section closely fitted to the turbine blades, defining therewith a ducted velocity turbine, and beneath the stack the housing surrounds the impeller and is connected to each of the runner passages, whereby all fuel/air mixture passes through the turbine and impeller. Usually the shaft is supported for rotation about a vertical axis, and a diffuser may be provided in the housing, being arranged in a generally horizontal circle surrounding the impeller to direct a flow of fuel-/air mixture exciting the impeller radially outward through said runner passages. The impeller includes a surface extending through a curvature of approximately 90° and a plurality of impeller blades projecting from its surface to accept the flow of fuel/air mixture exiting the turbine and to change the direction of such flow while returning energy into such flow.

6 Claims, 5 Drawing Figures

FREE-RUNNING ROTARY INDUCTION SYSTEM

BACKGROUND OF THE INVENTION

This invention relates to a device for improving the vaporization of fuel in carbureted or fuel injected spark ignition engines, particularly automobile and truck engines. Various devices have been proposed for insertion between the carburetor (usually) and the intake manifold of such engines, or in some instances also into the manifold themselves, for the purpose of promoting vaporization of the fuel particles that are entrained into the intake air stream as it passes through the carburetor. Within the use of the term "carburetor" are included so-called throttle body fuel injection devices, since these basically function to add fuel in small drop form into the intake air stream essentially at the same location, i.e. the central inlet to the engine intake manifold.

Such devices have, for almost eighty years, suggested the use of screen mesh (which in some cases may be heated), rotating members such as small thin propeller blades or the like which spin in response to the flow of air over them, and various combinations of these elements. The purpose is to promote vaporization of the fuel and/or mixing of it in the air stream, and a more uniform supply of the resultant fuel/air mixture to all the intake ports of the several engine cylinders at essentially the same fuel to air ratio. In addition to the use of these elements, many different designs of intake manifold have been proposed in order to achieve a uniform supply of fuel air mixture to all cylinders, since any good engine design must avoid one or more cylinders running with a lean or low fuel mixture which tends to cause overheating, misfiring, burning of associated valves, and other performance and maintenance problems which are well known.

Exemplary, but by no means exhaustive, of such devices disclosed in prior U.S. Pat. No. 942,503 of Dec. 7, 1909; U.S. Pat. No. 1,386,297 of Aug. 2, 1921; U.S. Pat. No. 3,952,716 of April 27, 1976 and related U.S. Pat. No. 4,059,082 of Nov. 22, 1977; and U.S. Pat. No. 4,422,432 of Dec. 27, 1983. These are merely illustrative of the patents on the subject matter.

A number of such devices are offered for sale, and in a recent evaluation report the U.S. Environmental Protection Agency listed ten devices under the title MIXTURE ENHANCERS (under the carb). The listing noted that none of these are expected to cause a statistically significant increase in fuel economy for a modern light duty motor vehicle in proper operating condition which is operated in a typical manner.

Also of interest to the background of the present invention are centrifugal compressors, both gear driven from engine crankshafts and driven by exhaust gas turbines, the latter also being known commonly as turbo-superchargers. Those devices, until recently, were more commonly found in aircraft engine designs, to enable high altitude and high output performance, and such devices go back well prior to 1940. Centrifugal superchargers coupled to radial air cooled engines, and driven from the crankshaft of such engines, were widely used on high altitude military aircraft in the era of late 1930's into the mid-1950's; turbo-superchargers have been utilized both in racing automobiles and in various forms of aircraft engines, particularly for military aircraft, and within the last few years also to obtain improved power and performance from smaller automotive engines without increasing the displacement of those engines. In each case, the compressor, most predominately a centrifugal compressor with associated diffuser, is used to increase the pressure of the fuel/air mixture being supplied to the cylinders of the engine. It is well recognized that accurate and rather complicated controls must be incorporated to limit the boost provided by the turbo-chargers, since they are not closely coupled with respect to engine speed, otherwise severe and sometimes permanent damage can be done to the engine itself.

In either instance, it is necessary to take into account the effect of adding such devices or systems upon the overall available power output of the engine, its expected life, and its maintenance. Supercharging in general places a greater strain on connecting rod and crankshaft bearings, and upon cylinder head gaskets, and in some instances upon the engine valves due to higher combustion chamber pressures, greater heat which must be dissipated, and the like. Compressors which are directly driven from the engine crankshaft by gears or belt, substract some power from the engine directly; turbo-chargers operate at high temperatures and create back pressures in the engine exhaust system which can have power reducing and overheating effects, and these usually require the use of a so-called waste gate (or bypass valve) which adds complication, expense and maintenance. Turbochargers also often require addition of an intercooler between the compressor and carburetor. It has been known, however, that the crankshaft driven centrifugal compressors such as used in radial air cooled aircraft engines do promote the mixing of fuel and air and vaporization of the fuel in the fuel-air mixture, as well as better and more even distribution of the mixture to all of the cylinders.

SUMMARY OF THE INVENTION

The present invention provides a free-running rotary induction system which will improve the vaporization and distribution in the fuel-air mixture moving from the carburetor to the several cylinders of internal combustion engines, particularly those designed for automotive service, without resort to a direct coupled drive from the crankshaft or to an exhaust gas turbine. A device constructed in accordance with the invention, and used in dynamometer testing of a typical automotive V-8 engine, having a displacement of approximately 350° cubic inches (5800 cc.) and equipped with a modified intake manifold which incorporated the device, exhibited significant improvements by way of decrease of specific fuel consumption, increased horsepower and torque, and improved cold starting performance. Decrease in specific fuel consumption in the otherwise unmodified engine will be accompanied by improvement in exhaust gas emissions, by reason of more efficient combustion within the engine. These improvements are modest, but significant, being in the order of 5 to 10%, and are considered to be of particular significance since they can be achieved by adapting the present invention to designs readily incorporated into various stock automotive engines without great expense.

The device provided by the invention includes a shaft extending from the engine intake manifold upward into the tubular intake stack upon which the carburetor (or throttle body injector) is supported, including the usual throttle plate for the engine. The fuel/air mixture passing through the throttle plate enters this tubular stack and passes through a high efficiency velocity turbine which is fastened to the shaft, while the shaft in turn is supported by one or more low friction bearings so as to be freely rotatable in response to rotation of this turbine. The turbine blades are closely fitted to the stack, thus providing an efficient ducted turbine.

The fuel/air mixture exiting the turbine blades enters a space in the stack where the mixture flows in a vortex-like fashion immediately into the inlet of an efficient centrifugal impeller which is also mounted on and driven from the shaft. The impeller preferably is provided with a surrounding stationary diffuser which functions to divide and smooth out the flow of the mixture exiting the rotating impeller, and from this diffuser the various runners of the inlet manifold extend to the intake ports of the several engine cylinders. The aggregate cross-sectional area of these runners is at least equal to the outlet area of the impeller/diffuser, so as to avoid back pressures in the fuel/air flow to the cylinder intakes. In accordance with good design practice, the length of these runners may be designed such that they are essentially of equal length, in order to assist in equalizing flow resistance and therefore flow velocity and mass to the several cylinders, although the action of the impeller helps to reduce difference in such division of flow.

Energy to rotate the turbine is derived from the mass flow of incoming fuel/air mixture from the carburetor. The mixture preferably passes through the blades of the ducted turbine with a minimum of turbulence, but exits typically from such turbine in somewhat of a vortex-type path, by reason of the interaction between the fluid flow and the turbine blades. Immediately thereafter this flow enters the centrifugal impeller, and the entry angle of the fuel/air mixture into the impeller blades is near 0°, which is the most efficient condition possible for such circumstances.

The rotating impeller and its blades perform several functions, both alone and in conjunction with the preferred surrounding diffuser blades or scroll. Some turbulence is induced into the mixture, resulting in improved distribution of fuel into the air and improved vaporization of the fuel. The fuel/air mixture is carried over the curved body surface of the impeller, and through its blades, and thereby assisted in an efficient manner to execute the turn between the tubular inlet stack and the manifold runners, thereby accellerating and guiding this flow in the critical area where, in ordinary manifold design even for high performance manifolds, it is necessary for the mixture to execute essentially a 90° turn in its flow path as the mixture proceeds to the several cylinders. The impeller, however is not closely shrouded and does not function as a compressor.

Thus, the system provides a free-running, rotating, relatively high speed device which promotes vaporization and assists the smooth and direct flow and its subsequent division out into the runners. In addition to minimizing the entry angle of the fluid flow into the impeller, the vortex flow of the mixture entering the impeller has the advantage of tending to direct the flow in a generally outward fashion, similar to a tornadic action, also enhancing the transition of the flow of the mixture exiting the turbine into the impeller by tending to avoid undesirable friction around the inlet hub area of the impeller.

Another benefit of the device is the result of its improved handling and mixing of the fuel/air fluid. In general, a simpler carburetor or throttle body injector system can be used on multi-cylinder engines, for example a single-venturi carburetor can be employed, thereby simplifying the design and function of the carburetor and/or injector as might be used in multi-cylinder engines, particularly of V-type design.

It has been found that a device constructed according to this invention noticeably improves the cold starting characteristics of an engine, and in some instances provides ample cold starting mixture without need for a choke or for the heat-exchange exhaust cross-over passages which are often used to improve cold start performance. This is significant because EPA regulations place rather stringent limits upon the choke "on time," and the extra passages and temperature responsive valves used to control exhaust gas heating, during cold starting, represent additional manufacturing cost and subsequent maintenance problems and expense.

Another benefit of the present invention is that retrofit intake manifold designs can readily be manufactured for existing engines, thereby enabling manufacturers to provide improved service parts to upgrade engines already sold and in service, as well as enabling them to upgrade their present designs without a complete redesign of the entire engine.

Other objects and advantages of the invention will be apparent from the following description, the accompanying drawings and the appended claims.

DESCRIPTION OF THE PREFERRED EMBODIMENT

Figure 1:
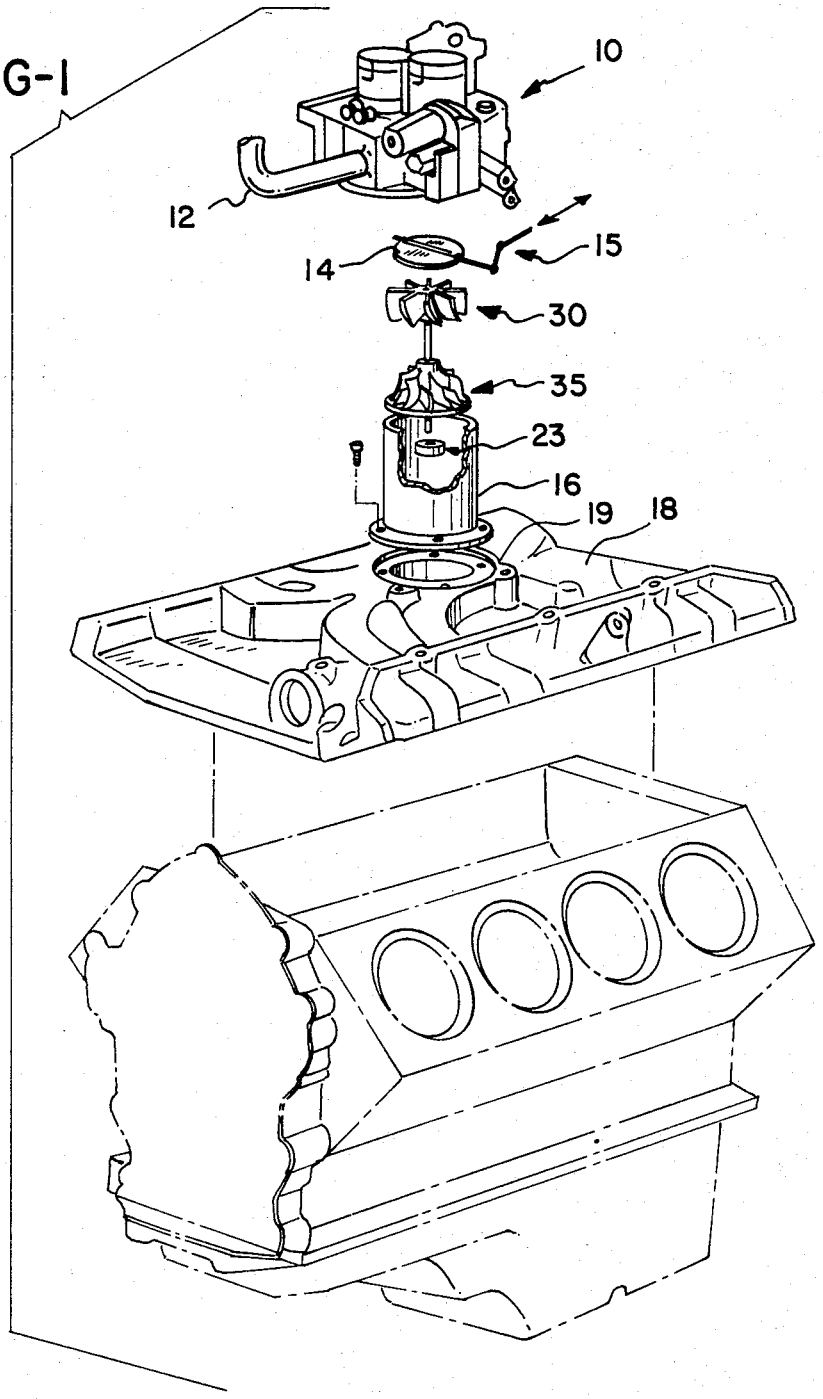
FIG. 1 is an exploded schematic view of a V-type engine equipped with a device in accordance with the invention.

FIG. 1 shows a typical automotive spark ignition internal combustion engine of the V-type. It should be understood however that the invention is applicable to many different forms of such an engine, and the V-type shown is merely illustrative. A carburetor 10 provides the inlet of combustion air to the engine and includes a fuel supply line 12 from which the carburetor forms an appropriate air-fuel mixture which passes to the inlet valves and combustion chambers of the engine through a throttle plate or valve 14, the position of which is controlled by throttle linkage 15.

Figure 2:
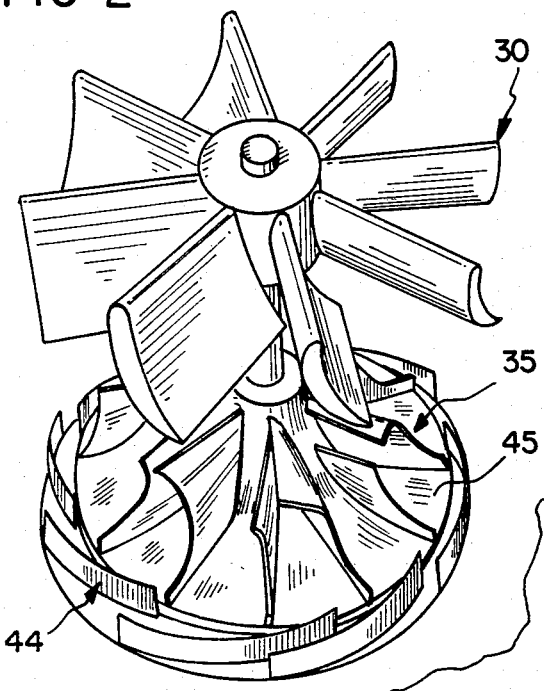
FIG. 2 is a perspective view of the turbine blades, shaft, and impeller.
Figure 3:
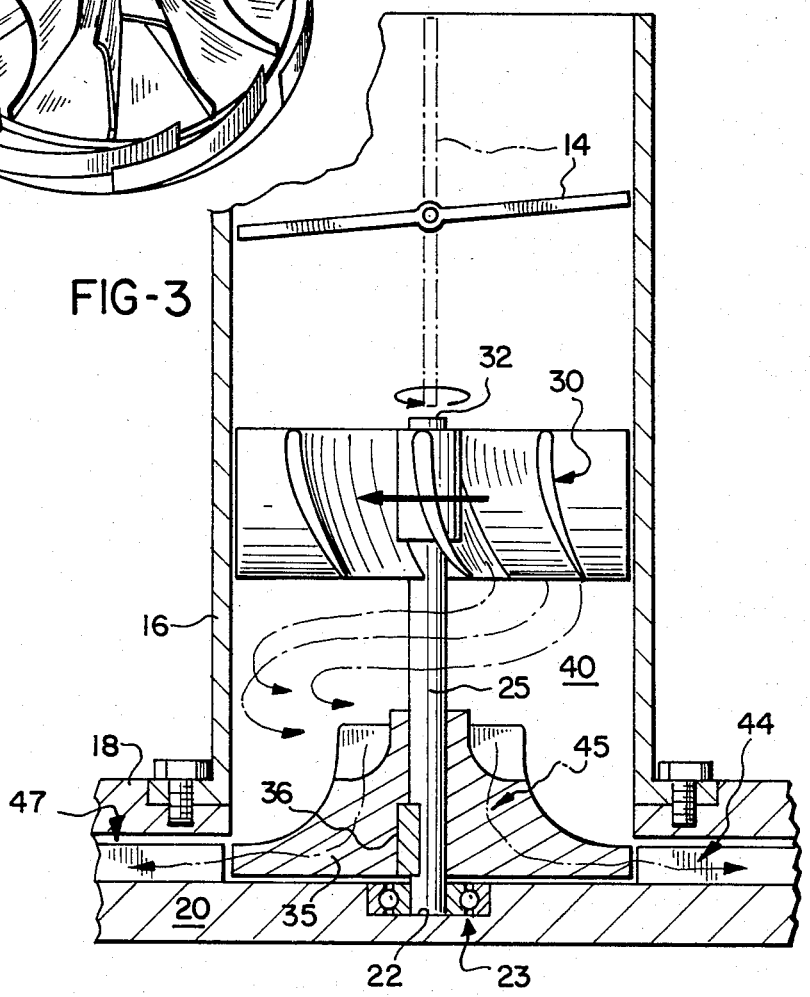
FIG. 3 is a schematic cross-sectionsal view of the device, illustrating its location with respect to the carburetor and intake manifold, and showing the approximate action of the fuel-air mixture flowing through the device.

The fuel-air mixture flowing past the throttle plate enters a tubular intake stack 16 (FIG. 2) which is supported on a special intake manifold 18. The manifold includes a central housing 19 to which the stack 16 is bolted. The floor 20 of the housing includes a recess 22 which contains a low friction bearing 23, such as a ball or roller bearing, and it in turn supports a shaft 25 which extends upward through a major portion of the stack. The shaft is free running; that is, it is not coupled to any rotating part of the engine. Rather, it is driven by an efficient velocity turbine 30 having airfoil type blades of appropriate design which extend radially outward, with appropriate pitch, from a hub 32 fixed to shaft 25. The interior surface of the stack 16 is closely spaced from the tips of the turbine blades, defining a form of ducted turbine, so essentially all the flow of fuel-air mixture moving down the stack reacts with the blades to spin the turbine at substantial speed.

At the bottom of the shaft 25, immediately above the floor 20, a centrifugal impeller 35 is fastened to shaft 25, as by a key 36, thus the impeller is rotated by the shaft which in turn in driven by turbine 30. Energy to rotate the turbine is in turn extracted from the fast flowing mass of fuel-air mixture or mixed fluid, which may still contain a substantial disperson of fuel droplets, by reason of the fact that the flow is immediately exiting the carburetor 10. The flow of air, and ensuing fuel droplets, is caused by the pumping action of the engine pistons in the engine cylinders which, during the intake stroke of each piston, are opened to the intake manifold in known manner. During partially open throttle conditions, the manifold vacuum or negative pressure may be in the order of fifteen to twenty inches of mercury, while at open throttle operation manifold vacuum may approach zero (this is frequently also defined in absolute pressure, e.g. twenty-nine inches of mercury). Each cylinder fills to its capacity once each cycle, or once every other revolution in the usual four-cycle engine, thus the flow through the turbine remains within a predetermined range according to size and design of the engine. However, the power to drive the turbine is not free, rather it is extracted in a manner which, it appears, has minimal effect on engine efficiency. The impeller does not function as a centrifugal compressor, thus it does not overload the turbine, yet uses the extracted energy in an efficient manner.

The flow of mixture exiting the turbine 30 enters a space or chamber 40 separating the turbine from the impeller 35, and in this chamber the flow follows a vortex type path, characteristic of gas flow discharging from turbine blades into an open space. This type of flow is advantageous since it tends to match the direction of flow to the entry into the blades of the impeller. An entry angle of near zero degrees is quite efficient in promoting the passage of the fluid into the impeller.

The impeller 35 preferably is surrounded at its outlet by a shroud or diffuser 44 which may be built into the roof of intake manifold 18. The impeller surface 45, curving smoothly downward and outward, carries the fuel-air mixture around the approximate 90 degree turn which is present in most intake manifolds, traversing change in direction from beneath the carburetor and stack 16 to the several outlet runners 47 of the manifold which serve to carry the mixture to the inlet valve of each cylinder. Thus at this transition the rapidly moving surface of the impeller is guiding the flow around the necessary turn and imparting centrifugal force to the fuel-air mixture, tending to mix the air and fuel thoroughly, to break up and promote vaporization of the fuel, to urge an essentially uniform mixture through each of the runners to the respective cylinders, and to minimize friction losses in the flow. The inlet areas of the manifold runners, in aggregate or total area, at least equal or may exceed the outlet area of the impeller and/or its shroud, to avoid unnecessary back pressure in the intake manifold.

The turbine and impeller thus are arranged to receive and act upon the entire flow of fuel/air mixture exiting the carburetor device 10 and moving to the intakes of the several cylinders of the engine. The velocity turbine extracts energy from the flow, and imparts a substantial part of this energy to the shaft and thus to the impeller. While obviously some energy is expended to overcome friction in the bearings and the inertia of the turbine blade/shaft/impeller assembly, a substantial part of the extracted energy is returned to the fuel/air flow while mixing the fuel and air and re-directing this flow into the intake manifold runners. Efficient design of these parts results in an over-all gain in engine efficiency.

Fuel/air mixing is enhanced by the initial interaction of the flow with the turbine blades, the vortex created at the turbine exit, and the interaction of the flow with the impeller. Because the turbine/impeller assembly is in the air intake flow, and the fuel is undergoing phase change in this region which absorbs heat energy, it is possible to construct the device from conventional relatively inexpensive materials, preferably light weight aluminum alloys.

Figure 5:
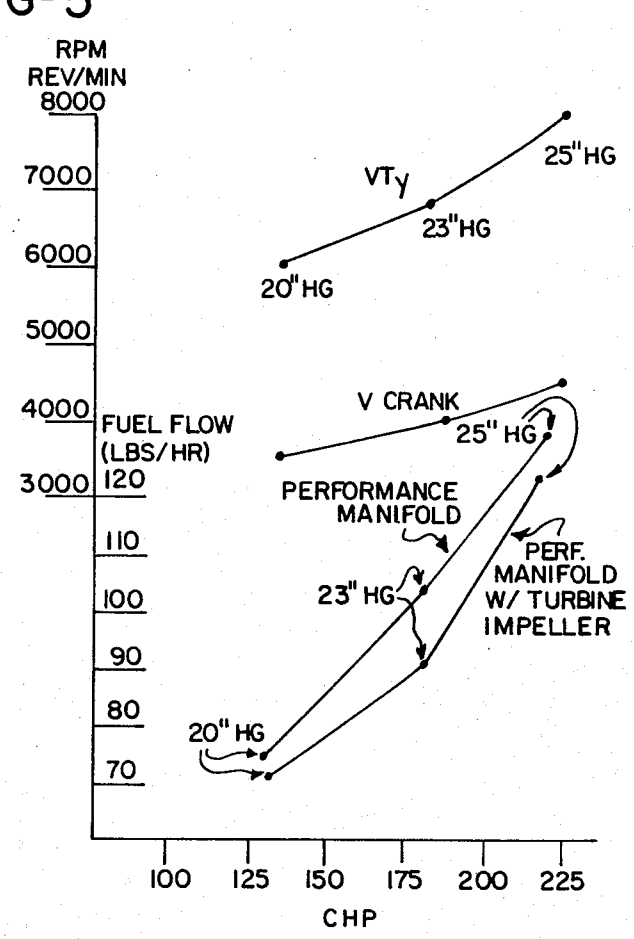
FIGS. 4 and 5 are diagrams showing performance improvements of an engine equipped with the invention.
Figure 4:
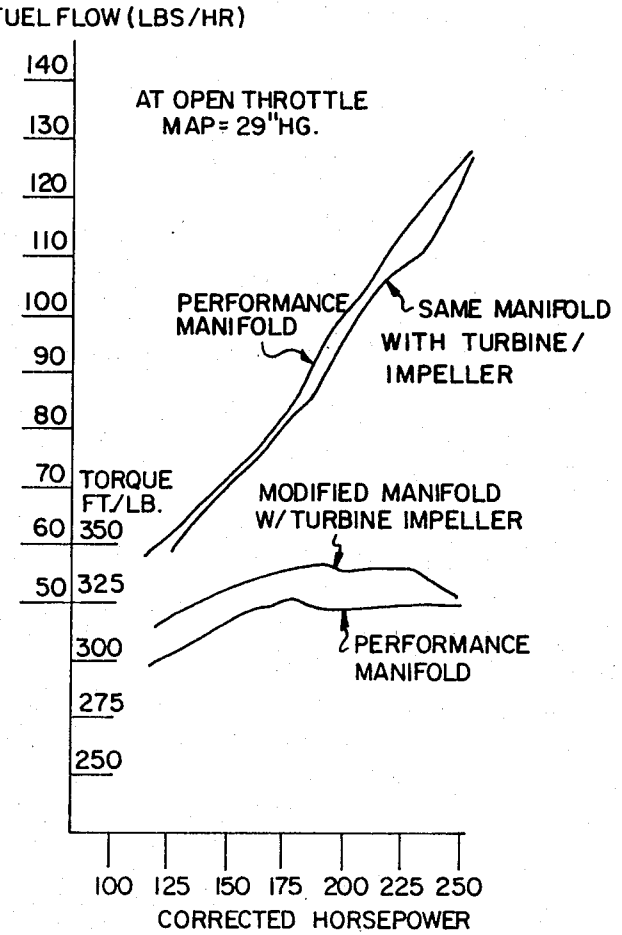

As mentioned at the beginning of this description, the system provided by this invention has been adapted to and tested upon a V-type four cycle automobile engine, specifically a Chevrolet 350 cubic inch V-8 engine. In place of the stock passenger car or "street" intake manifold, a performance manifold designed to fit this engine was utilized because of size constraints, and the device provided by the invention was adapted to fit in that manifold. The engine was tested on a conventional water brake dynamometer using this performance intake manifold, both with and without the device provided by the present invention. FIGS. 4 and 5 are graphs exhibiting the results of such tests.

In FIG. 4, the two upper curves are plots of fuel flow, expressed in pounds per hour, against corrected horsepower. In this sense, corrected horsepower incorporates the usual calculations to correct for barometric conditions. The two lower curves represent the results of plotting torque in foot-pounds.

The upper curve of the torque results represents readings obtained using the manifold with the free-running turbine/impeller device operating, and the lower curve expresses the results with the device removed. In the fuel consumption curves, the upper curve represents the results without the turbine/impeller device, and the lower curve expresses the results using the turbine/impeller device. The data for all of these curves was obtained operating the engine at full open throttle, with an observed manifold pressure of 29 inches Hg absolute.

It will be noted that when the free-running turbine/impeller device was utilized, there was a definite increase in torque output from the otherwise identical engine, and similarly a definite decrease in specific fuel consumption. It should be noted that in each case the curves tend toward merging at essentially full horsepower (250 CHP). This can be attributed to the fact that no compensation was introduced into the intake manifold for the reduction in intake cross section caused by the physical presence of the turbine/impeller device. Thus, at full throttle and full power, presence of the device introduced a slight reduction in total intake area, which accounts for the perceived tendency for the curves to merge at full power, whereas otherwise the curves are practically uniformly spaced, indicating improved torque, and improved fuel consumption, over a range of full throttle power output.

The lower section of FIG. 5 is a graph plotting corrected horsepower against fuel flow in pounds per hour, with the readings here having been taken at different throttle settings, ranging from 25 inches Hg to 20 inches Hg as noted. Again, definite improvement in specific fuel consumption resulted from the use of the turbine/impeller device over a range of part throttle operation.

The upper plot in FIG. 5 represents data comparing corrected horsepower with engine crankshaft speed (lower curve) and the rotational speed of the turbine/impeller device (upper curve), at the same part throttle operating conditions indicated in the lower part of FIG. 5. These curves indicate that, while the free-running turbine/impeller device increases in speed along with crankshaft speed, the relationship is not linear; as engine (crankshaft) speed increases toward full power, and more open throttle, the free-running rotational speed of the device increases at an even greater rate.

From the data as expressed in FIGS. 4 and 5, it can readily be seen that use of the free-running rotary induction system of the present invention provides significant improvement in the operation of the engine, and these results can readily be accomplished without noticeable extraction of power from the engine, and with a minimum of physical change in the engine. If anything, the system can lead to simplification in the engine and its accessories while achieving greater over-all efficiency.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An improved fuel distribution system for a multi-cylinder internal combustion engine which includes
- an intake manifold having
- an inlet stack with a mount for a carburetor and
- a plurality of runner passages below said stack extending to intake ports at each cylinder,
- a shaft having an axial flow turbine thereon and a radial flow impeller thereon spaced from said turbine,
- said manifold including bearing means providing a freely rotatable mounting for said shaft supporting said turbine in said stack and said impeller therebelow, and
- a diffuser in said manifold surrounding said impeller and connected to each of said runner passages.

2. The fuel distribution system of claim 1, said manifold including a central housing supporting said stack and communicating with said runner passages,
- said shaft being supported in said housing for rotation about a vertical axis, and
- said diffuser is arranged in a generally horizontal circle surrounding said impeller to direct a flow of combustible mixture radially outward to said runner passages.

3. An improved fuel distribution system for a multi-cylinder internal combustion engine, including
- an intake manifold having
- a tubular inlet stack with an inlet port including a mounting for a carburetor on the top thereof and
- a plurality of runner passages extending generally transverse to the bottom of the stack and to intake ports at each cylinder; the improvement comprising
- a shaft having a plurality of axial flow turbine blades thereon and a radial flow impeller thereon spaced from said turbine blades,
- said manifold including a housing downstream of said stack providing a freely rotatable mounting for said shaft and supporting said turbine blades therein closely spaced from the interior wall of said stack,
- said stack having a cylindrical interior wall section closely fitted to said blades defining therewith a ducted velocity turbine,
- said housing beneath said stack surrounding said impeller and being connected to each of said runner passages, whereby all fuel/air mixture passes through said turbine and said impeller.

4. The fuel distribution system of claim 3, wherein
- said shaft is supported for rotation about a vertical axis, and
- a diffuser in said housing, said diffuser being arranged in a generally horizontal circle surrounding said impeller to direct a flow of fuel/air mixture exiting said impeller radially outward through said runner passages.

5. The fuel distribution system of claim 3, wherein said impeller includes a surface extending through a curvature of approximately 90° and a plurality of impeller blades projecting from said surface to accept the flow of fuel/air mixture exiting said turbine and to change the direction of such flow while returning energy into such flow.

6. In a fuel distribution system for a multi-cylinder internal combustion engine having an intake passage including an inlet stack with a mount for a carburetor and runner passages below said stack extending to intake ports of the engine cylinders; the improvement comprising
- a shaft having axial flow turbine blades thereon and a radial flow impeller thereon spaced from said turbine blades, said stack cooperating with said blades to form a velocity turbine,
- bearing means in said intake passage providing a freely rotatable mounting for said shaft supporting said turbine in said stack and said impeller therebelow, and
- said intake passage surrounding said impeller and connected to each of said runner passages.

* * * * *